US008666081B2

(12) United States Patent
Oh et al.

(10) Patent No.: US 8,666,081 B2
(45) Date of Patent: Mar. 4, 2014

(54) APPARATUS FOR PROCESSING A MEDIA SIGNAL AND METHOD THEREOF

(75) Inventors: Hyen-O Oh, Seoul (KR); Jong Ha Moon, Seoul (KR); Myung Hoon Lee, Seoul (KR)

(73) Assignee: LG Electronics, Inc., Seoul (KR)

( * ) Notice: Subject to any disclaimer, the term of this patent is extended or adjusted under 35 U.S.C. 154(b) by 741 days.

(21) Appl. No.: 12/853,048

(22) Filed: Aug. 9, 2010

(65) Prior Publication Data

US 2011/0109722 A1 May 12, 2011

Related U.S. Application Data

(60) Provisional application No. 61/232,009, filed on Aug. 7, 2009.

(51) Int. Cl.
*H04R 5/00* (2006.01)

(52) U.S. Cl.
USPC ..... 381/17; 381/1; 381/18; 381/63

(58) Field of Classification Search
USPC ..... 381/1, 17–18, 63
See application file for complete search history.

(56) References Cited

U.S. PATENT DOCUMENTS

| | | | | |
|---|---|---|---|---|
| 5,657,391 | A * | 8/1997 | Jyosako | 381/1 |
| 7,369,665 | B1 * | 5/2008 | Cheng | 381/119 |
| 8,160,260 | B2 * | 4/2012 | Sakagami et al. | 381/17 |
| 8,340,303 | B2 * | 12/2012 | Chun | 381/17 |
| 8,391,498 | B2 * | 3/2013 | Potard | 381/1 |
| 2005/0053249 | A1 * | 3/2005 | Wu et al. | 381/310 |

* cited by examiner

*Primary Examiner* — Disler Paul
(74) *Attorney, Agent, or Firm* — Birch, Stewart, Kolasch & Birch, LLP

(57) ABSTRACT

A method for processing a media signal, comprising: receiving, by an audio processing apparatus, an audio signal including a first channel signal and a second channel signal; estimating center sound by applying a band-pass filter to the first channel signal and the second channel signal; obtaining a first ambient sound by subtracting the center sound from the first channel signal; obtaining a second ambient sound by subtracting the center sound from the second channel signal; applying at least one of delay and reverberation filter to at least one of the first ambient sound and the second ambient sound to generate a processed ambient sound; and, generating pseudo surround signal using the center sound and the processed ambient sound is provided.

16 Claims, 14 Drawing Sheets

(A)

(B)

APPARATUS FOR PROCESSING A MEDIA SIGNAL AND METHOD THEREOF

This application claims the benefit of the U.S. Provisional Patent Application No. 61/232,009, filed on Aug. 7, 2009, which is hereby incorporated by reference as if fully set forth herein.

BACKGROUND OF THE INVENTION

1. Field of the Invention

The present invention relates to an apparatus for processing a media signal and method thereof. Although the present invention is suitable for a wide scope of applications, it is particularly suitable for encoding or decoding an audio signal and the like.

2. Discussion of the Related Art

Generally, a stereo signal is outputted via 2-channel speakers or 2.1-channel speakers including left and right speakers, while a multichannel signal is outputted via 5.1-channel speakers including a left speaker, a right speaker, a center speaker, a left surround speaker, a right surround speaker and an LFE (low frequency enhancement) speaker.

However, in a stereo system corresponding to 2- or 2.1-channel speakers, since speakers exist in front but fail to exist in surround, it is difficult for a user to experience 3-dimensional (3D) effect and presence by hearing the sound reproduced from the speakers in front.

SUMMARY OF THE INVENTION

Accordingly, the present invention is directed to an apparatus for processing a media signal and method thereof that substantially obviate one or more problems due to limitations and disadvantages of the related art.

An object of the present invention is to provide an apparatus for processing a media signal and method thereof, by which a 3D sound effect can be given to a stereo signal for a stereo system.

Another object of the present invention is to provide an apparatus for processing a media signal and method thereof, by which complexity can be lowered by maintaining a quality of 3D sound effect in providing and extracting a center sound and an ambient sound from an audio signal appropriately.

A further object of the present invention is to provide an apparatus for processing a media signal and method thereof, by which a 3D sound effect can be automatically given to an audio signal in case of a content corresponding to 3D video.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for processing a media signal, comprising: receiving, by an audio processing apparatus, an audio signal including a first channel signal and a second channel signal; estimating center sound by applying a band-pass filter to the first channel signal and the second channel signal; obtaining a first ambient sound by subtracting the center sound from the first channel signal; obtaining a second ambient sound by subtracting the center sound from the second channel signal; applying at least one of delay and reverberation filter to at least one of the first ambient sound and the second ambient sound to generate a processed ambient sound; and, generating pseudo surround signal using the center sound and the processed ambient sound is provided.

According to the present invention, a frequency range of the band-pass filter is based on voice band.

According to the present invention, a frequency range of the band-pass filter is from about 250 Hz to about 5 kHz.

According to the present invention, the method further comprises cancelling cross-talk on at least one of the first ambient sound and the second ambient sound; wherein the at least one of delay and reverberation filter is applied to the first ambient sound or the second ambient sound from which the cross-talk is cancelled.

According to the present invention, the center sound is estimated by the band-pass filter to a sum signal which is generated by adding the first channel signal to the second channel signal.

According to the present invention, the method further comprises receiving a video signal including at least one of a first picture data and a second picture data; wherein, when 3D video picture is outputted based on the video signal, the pseudo surround signal is generated.

According to the present invention, the method further comprises deciding whether the 3D video picture is outputted, according to 3D identification information, wherein the 3D identification information corresponds to at least one of presence of depth information, number information of pictures, and conversion information.

According to the present invention, the presence of depth information is generated according to whether the video signal includes depth information, wherein the number information of pictures is generated according to whether two pictures are decoded from the video signal, and, wherein the conversion information is generated according to whether one picture is converted into two pictures.

According to the present invention, the 3D video picture is outputted according to 3D selection information estimated from user input or setting information.

In another aspect of the present invention, an apparatus for processing a media signal, comprising: a center sound extracting part receiving an audio signal including a first channel signal and a second channel signal, estimating center sound by applying a band-pass filter to the first channel signal and the second channel signal, obtaining a first ambient sound by subtracting the center sound from the first channel signal, and obtaining a second ambient sound by subtracting the center sound from the second channel signal; a processing part applying at least one of delay and reverberation filter to at least one of the first ambient sound and the second ambient sound to generate a processed ambient sound; and, a generating part generating pseudo surround signal using the center sound and the processed ambient sound is provided.

According to the present invention, a frequency range of the band-pass filter is based on voice band.

According to the present invention, a frequency range of the band-pass filter is from about 250 Hz to about 5 kHz.

According to the present invention, the apparatus further comprises a C-T-C part cancelling cross-talk on at least one of the first ambient sound and the second ambient sound; wherein the at least one of delay and reverberation filter is applied to the first ambient sound or the second ambient sound from which the cross-talk is cancelled.

According to the present invention, the center sound is estimated by the band-pass filter to a sum signal which is generated by adding the first channel signal to the second channel signal.

According to the present invention, the apparatus further comprises a video decoder receiving a video signal including at least one of a first picture data and a second picture data; wherein, when 3D video picture is outputted based on the video signal, the pseudo surround signal is generated.

According to the present invention, the apparatus further comprises a rendering control unit deciding whether the 3D video picture is outputted, according to 3D identification information, wherein the 3D identification information corresponds to at least one of presence of depth information, number information of pictures, and conversion information.

According to the present invention, the presence of depth information is generated according to whether the video signal includes depth information, wherein the number information of pictures is generated according to whether two pictures are decoded from the video signal, and, wherein the conversion information is generated according to whether one picture is converted into two pictures.

According to the present invention, the 3D video picture is outputted according to 3D selection information estimated from user input or setting information.

Accordingly, the present invention provides the following effects and/or advantages.

First of all, the present invention gives a delay or reverberation effect to an ambient sound as well as a center sound, thereby enabling a virtual surround signal having a 3D sound effect to be outputted via stereo speakers.

Secondly, the present invention extracts a center sound corresponding to a specific frequency band and sets the rest of sound to an ambient sound, thereby considerably lowering complexity by maintaining a quality of a 3D sound effect.

Thirdly, the present invention eliminates crosstalk of an ambient sound only instead of eliminating crosstalk of a whole stereo signal, thereby considerably reducing sound quality distortion and computation quantity.

Finally, the present invention gives a 3D sound effect to audio selectively according to whether a specific content is reproduced as 3D, thereby processing an audio signal to be suitable for video characteristics.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. First of all, terminologies or words used in this specification and claims are not construed as limited to the general or dictionary meanings and should be construed as the meanings and concepts matching the technical idea of the present invention based on the principle that an inventor is able to appropriately define the concepts of the terminologies to describe the inventor's invention in best way. The embodiment disclosed in this disclosure and configurations shown in the accompanying drawings are just one preferred embodiment and do not represent all technical idea of the present invention. Therefore, it is understood that the present invention covers the modifications and variations of this invention provided they come within the scope of the appended claims and their equivalents at the timing point of filing this application.

According to the present invention, terminologies in the following description can be construed as the following references. And, terminologies not disclosed in this specification can be construed as the following meanings and concepts matching the technical idea of the present invention as well. Specifically, 'coding' can be construed as 'encoding' or 'decoding' selectively and 'information' in this disclosure is the terminology that generally includes values, parameters, coefficients, elements and the like and its meaning can be construed as different occasionally, by which the present invention is non-limited.

In this disclosure, in a broad sense, an audio signal is conceptionally discriminated from a video signal and designates all kinds of signals that can be auditorily identified. In a narrow sense, the audio signal means a signal having none or small quantity of speech characteristics. Audio signal of the present invention should be construed in a broad sense. Yet, the audio signal of the present invention can be understood as an audio signal in a narrow sense in case of being used as discriminated from a speech signal.

Although coding is specified to encoding only, it can be construed as including both encoding and decoding.

And, a media signal conceptionally indicates such a signal including an audio signal, a video signal and the like of various types.

Figure 1:
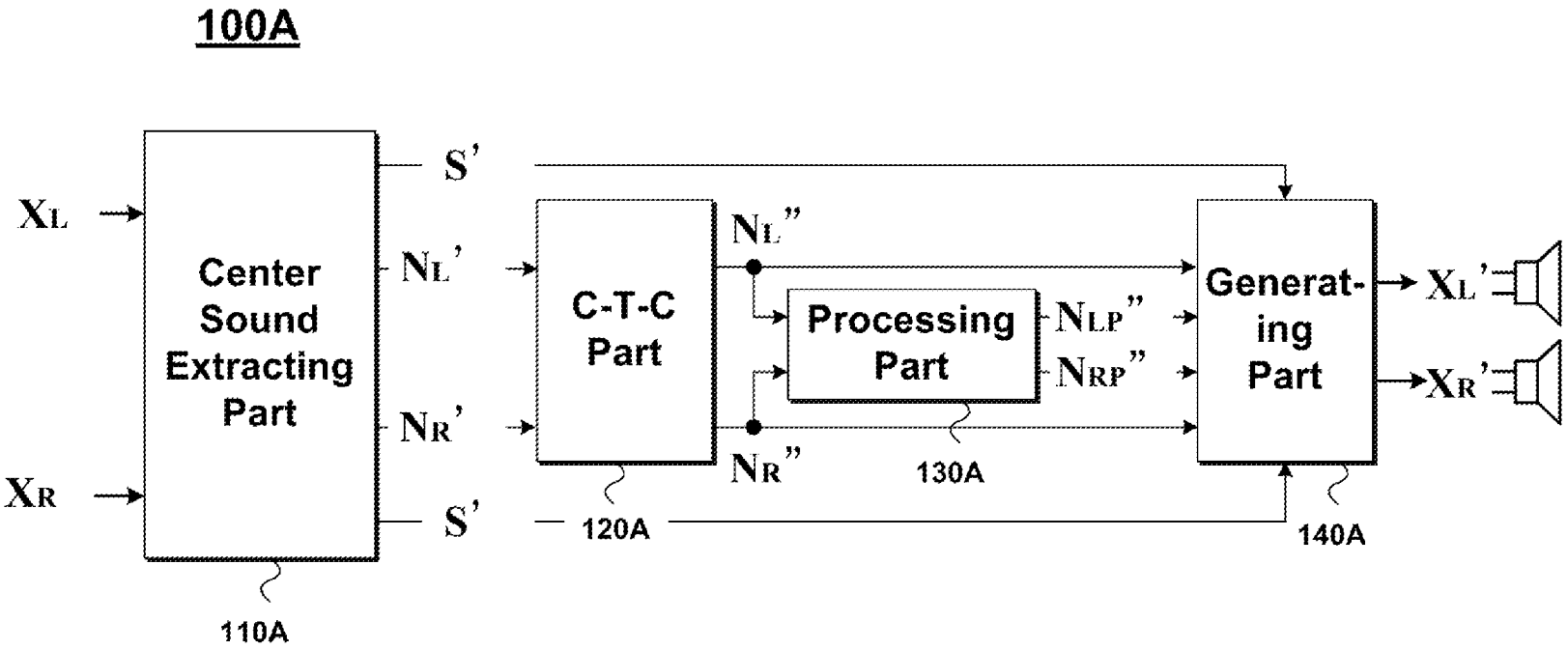
FIG. 1 is a block diagram of an audio 3D rendering unit in a media signal processing apparatus according to a first embodiment of the present invention.

FIG. 1 is a block diagram of an audio 3D rendering unit in a media signal processing apparatus according to a first embodiment of the present invention. For reference, the entire configuration of the media signal processing apparatus shall be described with reference to FIG. 9 later.

Referring to FIG. 1, an audio 3D rendering unit 100A according to a first embodiment of the present invention includes a center sound extracting part 110A, a processing part 130A and a generating part 140A and can further include a C-T-C (crosstalk cancellation) part 120A. Before describing the components including the center sound extracting part 110A, concepts of a direct sound, a center sound and an ambient sound shall be explained as follows.

Figure 2:
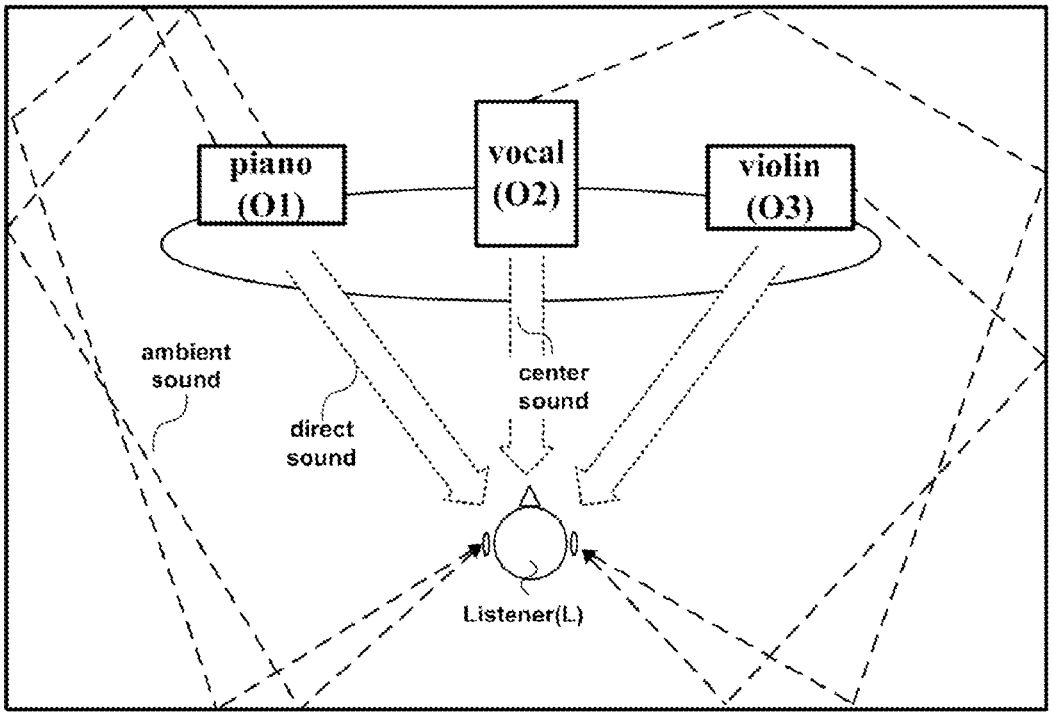
FIG. 2 is a diagram for concepts of a direct sound, a center sound and an ambient sound in user's listening environment.

FIG. 2 is a diagram for concepts of a direct sound, a center sound and an ambient sound in user's listening environment.

Referring to FIG. 2, in such a listening environment surrounded by a wall as a concert hall, an auditorium, a theater and the like, objects and/or sound sources including musical instruments and vocals and/or sound sources (e.g., a piano O1, a vocal O2, and a violin O3) are located on a stage in front and a user or listener L is located at a seat. In this case, a sound directly delivered to the listener L with directionality from the vocal or instrument on the stage shall be named a direct sound. On the contrary, such a sound heard in all directions without directionality as applause sound, noise, a reverberant sound and the like shall be named an ambient sound.

In particular, the direct sound is a sound heard in a specific direction (specifically, a side in front of a user), while the ambient sound is a sound heard in al directions. The user senses a sound direction based on the direct sound and also senses feeling or 3D effect for a space, to which the user belongs, based on the ambient sound.

In more particular, a signal located at a right center spatially in the direct sound shall be named a center sound. The center sound corresponds to a vocal in case of music, while corresponding to a dialogue in case of a movie content.

Figure 3:
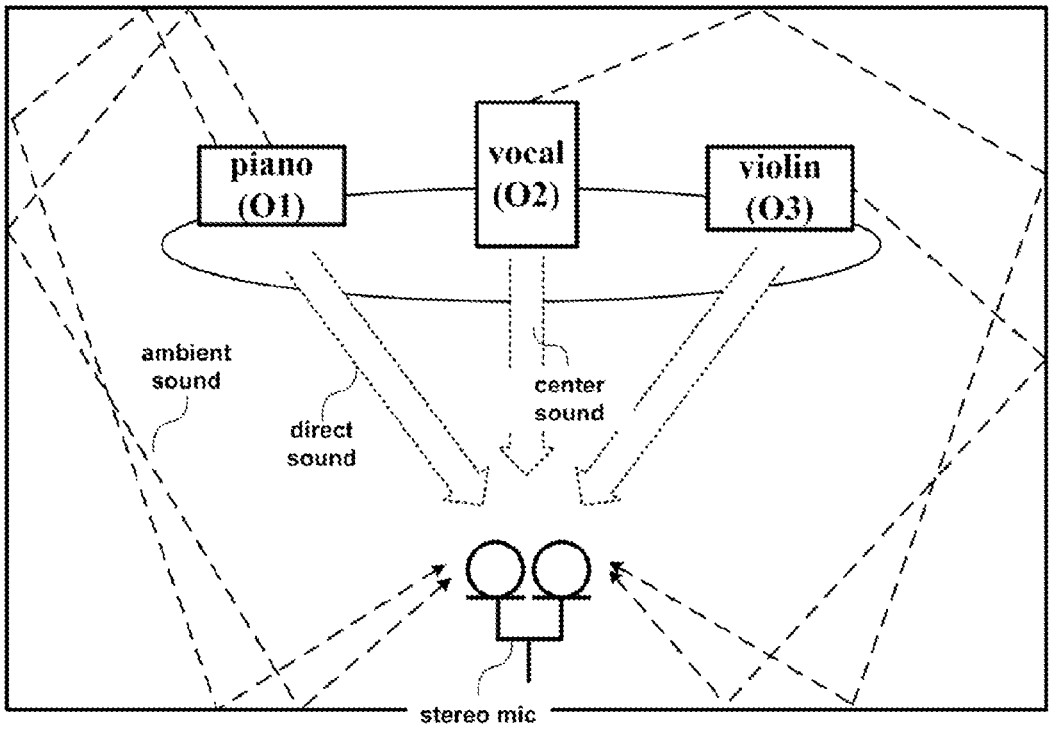
FIG. 3 and FIG. 4 are diagrams for examples of a process for recording an audio signal including a direct sound and an ambient sound.

In the following description, examples of a process for recording an audio signal including a direct sound and an ambient sound are explained with reference to FIG. 3 and FIG. 4. FIG. 3 shows a case that an audio signal is recorded by leaving a stereo microphone at a location of a listener in such a listening environment as shown in FIG. 2. And, FIG. 4 shows a case that an audio signal is recorded by leaving a plurality of microphones around such a sound source as a musical instrument, a vocal and the like.

Referring to FIG. 3, an audio signal is recorded via a stereo microphone at such a location of a listener as a seat. In this case, like sounds entering user's ears, the audio signal including an ambient sound as well as a direct sound including a center sound is recorded.

Figure 4:
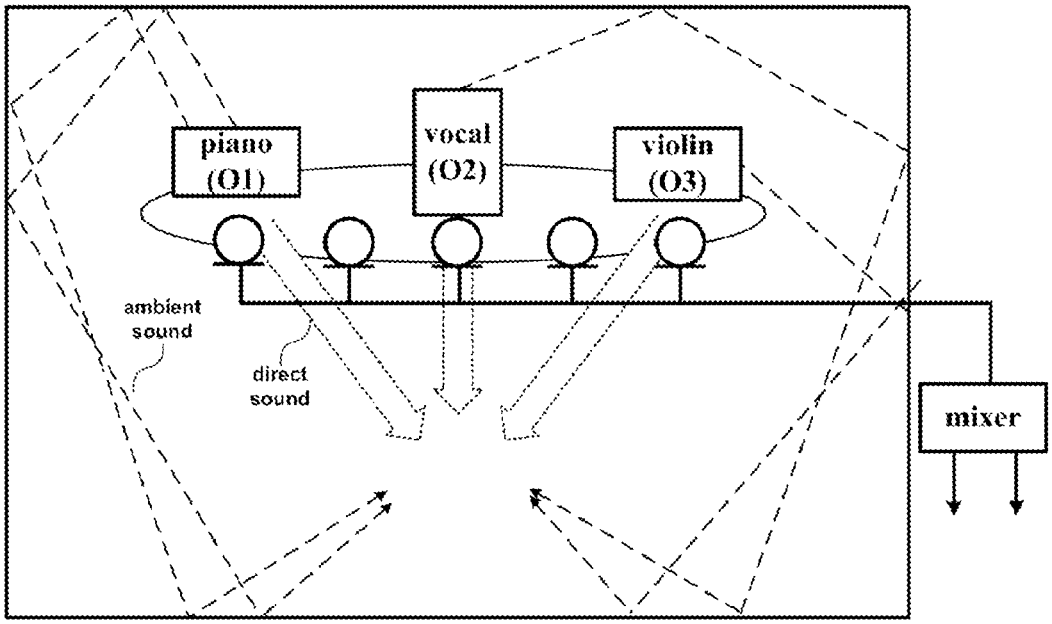

Referring to FIG. 4, since a microphone is located right next to a sound source on a stage instead of belong located at a seat, a direct sound from the sound source is recorded only but an ambient sound is barely recorded. In this case, the audio signal recorded via each microphone can become a stereo signal through an appropriate combination in a manner that an ambient sound and the like are added by a mixer.

Thus, the audio signal recorded or generated by the method shown in FIG. 3 or FIG. 4 is a stereo signal including a direct sound and an ambient sound. Meanwhile, when a stereo signal is recorded, a location of a microphone may be different from that of a speaker on reproduction. This is described with reference to FIG. 5 as follows.

Figure 5:
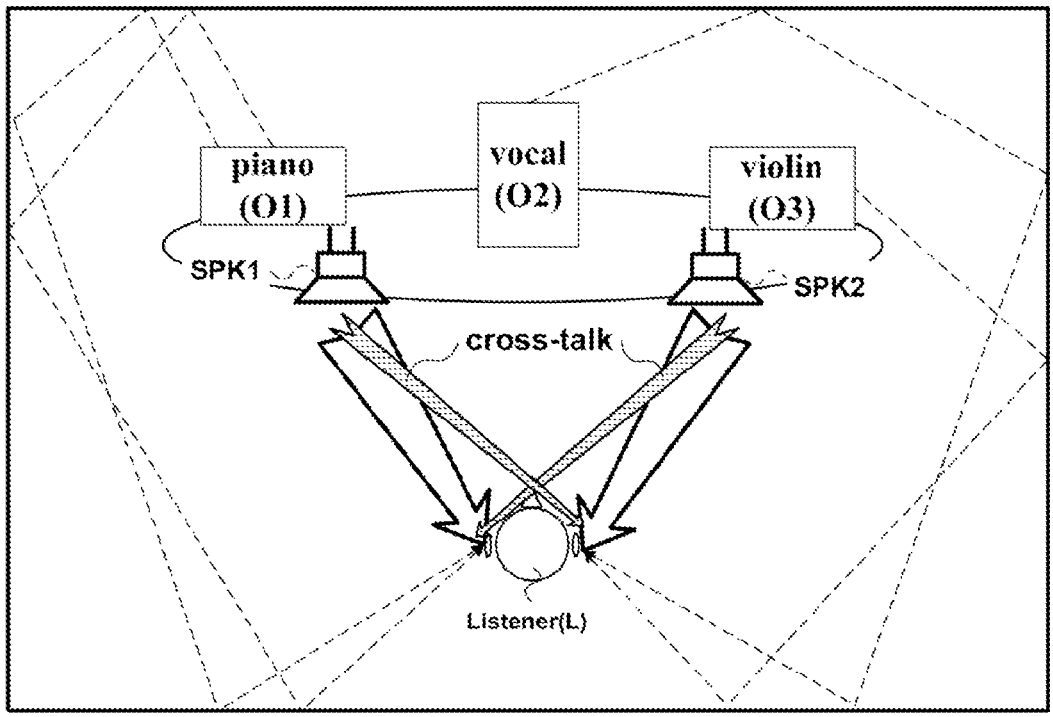
FIG. 5 is a diagram for explaining a playback environment in a stereo system.

FIG. 5 is a diagram for explaining a playback environment in a stereo system.

Referring to FIG. 5, unlike the microphone location in FIG. 3, it can be observed that speakers SPK1 and SPK2 for reproducing a stereo signal are located in front of a listener. Thus, when a stereo signal is outputted from speakers located in front of a user, a direct sound can be smoothly delivered to a listener. Yet, it may be a problem that an ambient sound heard from a lateral or rear side of a user on recording may not be correctly delivered to a listener. In order to correctly deliver an ambient sound, prescribed processing is required. For this, the present invention proposes 3D rendering units 100A, 100B and 100C according to first to third embodiments.

Meanwhile, sounds outputted from the left and right speakers SPK1 and SPK2 should be delivered to left and right ears of a listener, respectively to enable the listener to sense a 3D effect in a manner that the same sound of the real recording environment shown in FIG. 3 is reproduced. Yet, referring to FIG. 5, the sounds outputted from the left and right speakers SPK1 and SPK2 are delivered to the right and left ears of the listener, respectively. This problem is called 'crosstalk'. As the listener has difficulty in listening to the left and right sounds distinctively due to the crosstalk, a sound quality may become distorted. To prevent the sound quality distortion, a crosstalk removing technique has been developed.

Referring now to FIG. 1, the center sound extracting part 100A receives a stereo signal $X_L$ and $X_R$ generated by the former method described with reference to FIG. 3 or FIG. 4. Optionally, the stereo signal recorded by the above method undergoes a channel encoding/decoding process and an audio encoding/decoding process and can be then inputted to the center sound extracting part 100A. This shall be explained with reference to FIG. 9 later.

The stereo signal includes a first channel signal (e.g., a left channel signal) and a second channel signal (e.g., a right channel signal). Moreover, as mentioned in the foregoing description, the stereo signal includes a direct sound containing a center sound, an ambient sound and the like. If a virtual surround effect is given to the center sound and the like of the stereo signal, a tone distortion may occur. Hence, the center sound extracting part 100A extracts a center sound and then handles the rest as an ambient sound.

First of all, a stereo signal is represented as a direct sound D in the following.

$$X_L=a*D+n_L$$

$$X_R=b*D+n_R \qquad \text{[Formula 1]}$$

In Formula 1, $X_L$ indicates a left channel, $X_R$ indicates a right channel, D indicates a direct sound, $n_L$ indicates an ambient sound of the left channel, $n_R$ indicates an ambient sound of the right channel, a indicates a gain, and b indicates another gain.

If a signal having left and right channel signals, of which gains are equal to each other, in a direct sound is defined as a center sound S, Formula 1 can be developed into Formula 2.

$$X_L=S+c*D'+n_L$$

$$X_R=S+d*D'+n_R \qquad \text{[Formula 2]}$$

In Formula 2, D' indicates a direct sound from which a center sound is removed. And, c and d are gains, respectively.

Meanwhile, using the center sound removed direct sound and the ambient sound, a new ambient sound can be defined as Formula 3.

$$X_L=S+N_L$$

$$X_R=S+N_R \quad \text{[Formula 3]}$$

The center sound extracting part 110A extracts a center sound from the stereo signal based on the definition in Formula 3.

In particular, the center sound extracting part 110A generates a sum signal by adding the left and right channel signals of the stereo signal together.

$$\text{sum signal}=X_L+X_R=2S+N_L+N_R \quad \text{[Formula 3]}$$

Subsequently, the sum signal is made to enter a band pass filter and is then divided by 2 to extract a center sound S'.

$$S'=0.5*BPF(X_L+X_R) \quad \text{[Formula 4]}$$

In this case, a frequency range of the band pass filter can correspond to a human voice band and may correspond to 250 Hz to 5 kHz. This uses the property that a center sound including human voice is concentrated on a specific band.

Instead of the formula 4, band pass filter can be left channel signal $X_L$ and right channel signal $X_R$ respectively, then, the results sum up into the center sound S' as follow:

$$S'==0.5*\{BPF(X_L)+BPF(X_R)\} \quad \text{[Formula 4-2]}$$

Afterwards, the center sound extracting part 110A generates a first ambient sound (e.g., a left ambient sound) and a second ambient sound (e.g., a right ambient sound) using the extracted center sound S' and the stereo signal as follows.

$$N_L'=X_L-S'$$

$$N_R'=X_R-S' \text{[Formula 5]}$$

In Formula 5, $N_L'$ indicates a first ambient sound and $N_R'$ indicates a second ambient sound.

As mentioned in the foregoing description of Formula 3, the first and second ambient sounds have the concept of including the ambient sound and a signal that is not a center sound in the direct sound according to Formula 1 and Formula 2.

In particular, the first ambient sound $N_L'$ is obtained by subtracting the center sound S' from the first channel signal $X_L$, while the second ambient sound $N_R'$ is obtained by subtracting the center sound S' from the second channel signal $X_R$.

Thus, the center sound S' extracted by the center sound extracting part 110A is delivered to the generating part 140A and the first and second ambient sounds $N_L'$ and $N_R'$ are inputted to the C-T-C part 120A.

The C-T-C (cross-talk cancellation) part 120A removes crosstalk for the first and/or second ambient sounds $N_L'$ and/or $N_R'$. Concept of the crosstalk shall be explained with reference to FIG. 6 as follows.

Figure 6:
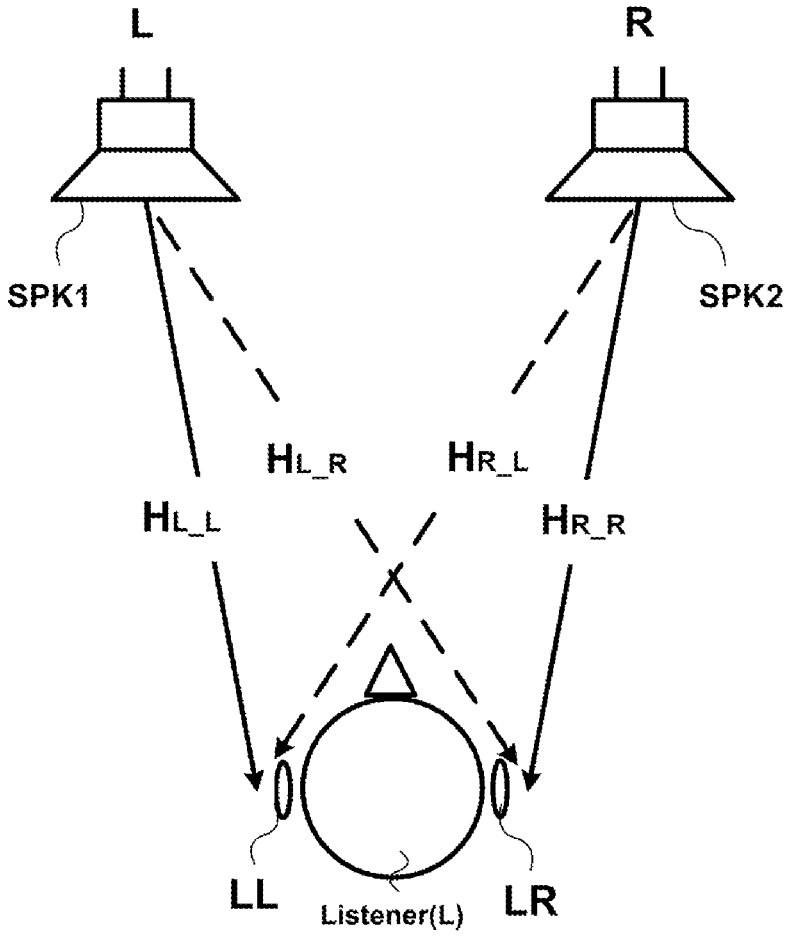
FIG. 6 is a diagram for explaining an audio signal delivery path and concept of crosstalk.

FIG. 6 is a diagram for explaining an audio signal delivery path and concept of crosstalk.

Referring to FIG. 6, $H_{L_L}$ indicates a delivery path from a left speaker SPK1 L to a left ear of a listener, $H_{L_R}$ indicates a delivery path from the left speaker SPK1 L to a right ear LR of the listener, $H_{R_L}$ indicates a delivery path from a right speaker SPK2 R to the left ear LL of the listener, and $H_{R_R}$ indicates a delivery path from the right speaker SPK2 R to the right ear LR of the listener.

The C-T-C (cross-talk cancellation) part 120A eliminates crosstalk for the first ambient sound $N_L'$ and/or the second ambient sound $N_R'$. For convenience, in Formulas 6 to 9 in the following description, a notation of the first ambient sound $N_L'$ shall be abbreviated L and a notation of the second ambient sound $N_R'$ shall be abbreviated R.

First of all, regarding the first ambient sound L and the second ambient sound R, a signal L0 delivered to a left ear of a listener and a signal delivered to a right ear of the listener can be represented as Formula 6.

$$L_0=L*H_{L_L}+R*H_{R_L}$$

$$R_0=R*H_{R_R}+L*H_{L_R} \quad \text{[Formula 6]}$$

In Formula 6, * indicates a convolution operation.

As mentioned in the foregoing description, a component $R*H_{R_L}$ of L0 and a component $L*H_{L_R}$ of R0 correspond to the unintended signal, i.e., the crosstalk.

Assuming that a listener is located at a center between the left and right speakers, a delivery path attributed to bilateral symmetry establishes the following equation.

$$H_{R_L}=H_{L_R}$$

$$H_{L_L}=H_{R_R} \quad \text{[Formula 7]}$$

Assuming $H_{L_L}=H_{R_R}=1$, the CTC function for processing the crosstalk elimination can be defined to play a role as follows.

$$CTC(L)=-R*H_{R_L}$$

$$CTC(R)=-L*H_{L_R} \quad \text{[Formula 8]}$$

In Formula 8, the CTC function CTC( ) can be schematically designed using a delay and a gain.

In Formula 6, if L+CTC(R) is inputted instead off the first ambient sound L and R+CTC(L) is inputted instead of the second ambient sound R, Formula 6 can be summarized as follows.

$$\begin{aligned} L_0 &= (L+CTC(R))^*H_{L_L}+R^*H_{R_L} \quad \text{[Formula 9]} \\ &= (L+CTC(R))^*1+R^*H_{R_L} \\ &= L+CTC(R)+R^*H_{R_L} \\ &= L+(-R^*H_{R_L})+R^*H_{R_L} \\ &= L \end{aligned}$$

$$\begin{aligned} R_0 &= (R+CTC(L))^*H_{R_R}+L^*H_{L_R} \\ &= (R+CTC(L))^*1+L^*H_{L_R} \\ &= R+CTC(L)+L^*H_{L_R} \\ &= R+(-L^*H_{L_R})+L^*H_{L_R} \\ &= R \end{aligned}$$

According to the above formula, the signal $L_0$ entering the left ear becomes the first ambient sound L outputted from the left speaker L itself and the signal $R_0$ entering the right ear becomes the second ambient sound R outputted from the right speaker R itself. Therefore, it can be observed that the crosstalk has been eliminated.

In particular, the C-T-C part 120$^a$ eliminates the crosstalk for the first and second ambient sounds $N_L'$ and $N_R'$ through the above process, thereby generating a crosstalk-eliminated first ambient sound $N_L''$ and a crosstalk-eliminated second ambient sound $N_R''$, as shown in Formula 10.

$$N_L''=N_L'+CTC(N_L')$$

$$N_R''=N_R'+CTC(N_R') \quad \text{[Formula 10]}$$

The crosstalk-eliminated ambient sounds $N_L''$ and $N_R''$ (or, if there is no CTC part, the ambient sounds $N_L'$ and $N_R'$ before the crosstalk elimination) are inputted to the processing part 130$^a$ and the generating part 140A.

The processing part 130$^{\alpha}$ applies a delay and/or reverberation filter to the first ambient sound $N_L''$ and/or the second ambient sound $N_R''$, thereby generating a processed ambient sound shown in Formula 11.

$$RVB(N_L'') \quad \text{[Formula 11]}$$

$RVB(N_R'')$, where RVB( ) indicates a delay/reverberation effect function.

In Formula 11, the delay and/or reverberation filter is applied to provide a surround effect. Since a delivery path of an ambient sound is normally greater than that of a direct sound, a listener is enabled to sense a 3D effect and a virtual surround effect if the delay and/or reverberation filter is applied.

In this case, the delay/reverberation effect function RVB( ) can be implemented using a feedback loop having a delay and gain, by which the present invention is non-limited.

The generating part 140A generates a virtual surround signal (i.e., a signal generated from enhancing a virtual surround effect of an original stereo signal) $X_L'$ and $X_R'$ using the center sound S' and the processed ambient sound $RVB(N_L'')$ (and the crosstalk-eliminated ambient sound $N_L''$). This is represented as Formula 12.

$$X_L'=G_1*S'+G_2*N_L''+G_3*RVB(N_L'')$$

$$X_R'=G_1*S'+G_2*N_R''+G_3*RVB(N_R'') \quad \text{[Formula 12]}$$

In Formula 12, $G_1$, $G_2$ and $G_3$ indicate gain values of components, respectively, S' indicates a center sound, $N_L''$ indicates an ambient sound (crosstalk eliminated), and RVB ($N_L''$) indicates a processed ambient sound.

So far, in the above description, the audio 3D rendering unit according to the first embodiment of the present invention are described. In the following description, audio 3D rendering units according to second and third embodiments of the present invention shall be described with reference to FIG. 7 and FIG. 8.

Figure 7:
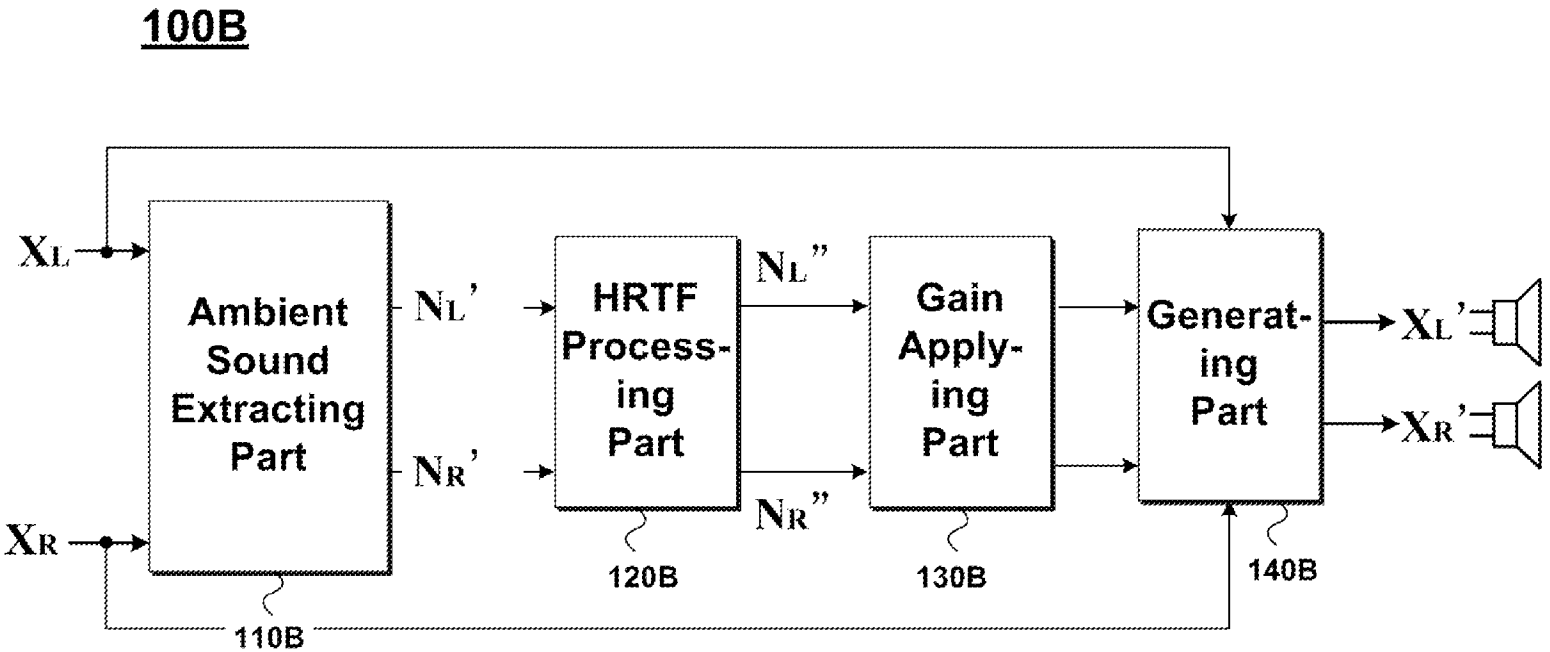
FIG. 7 is a block diagram of an audio 3D rendering unit in a media signal processing apparatus according to a second embodiment of the present invention.
Figure 8:
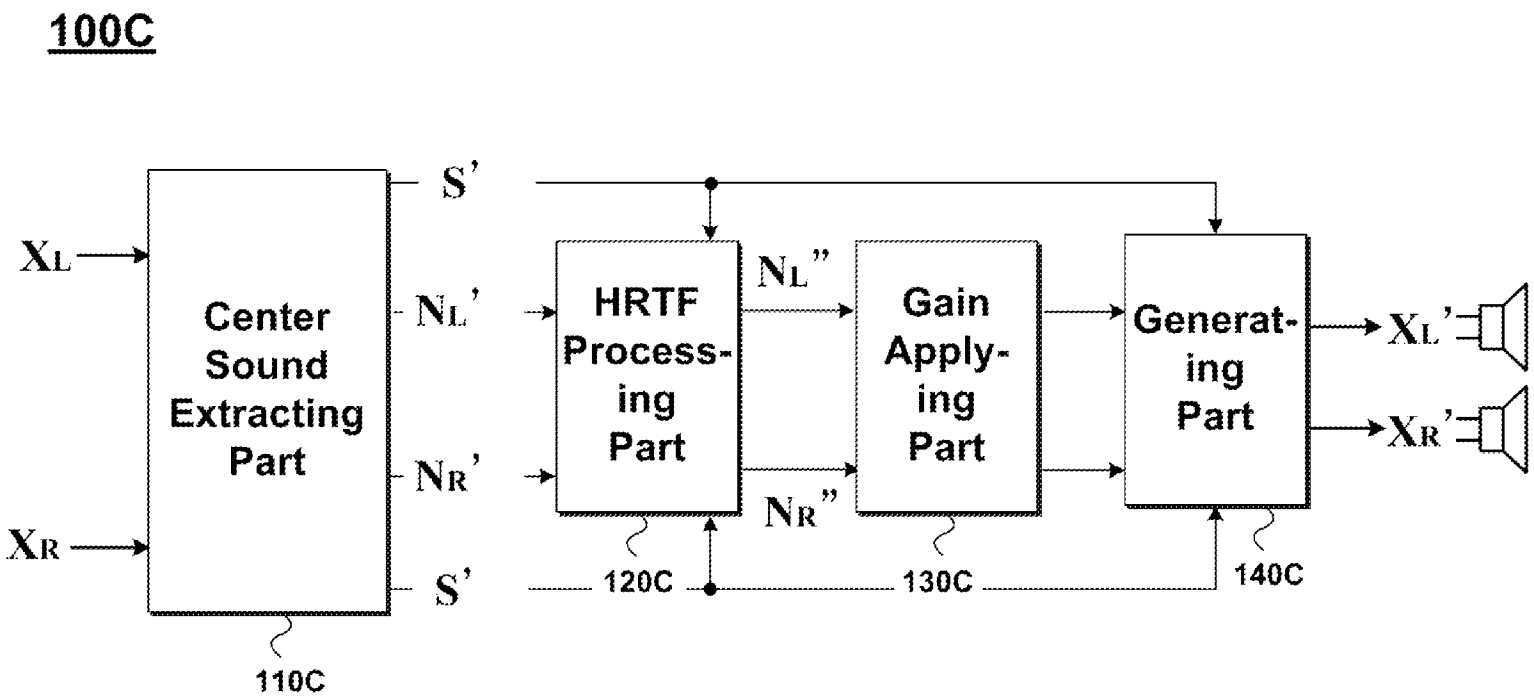
FIG. 8 is a block diagram of an audio 3D rendering unit in a media signal processing apparatus according to a third embodiment of the present invention.

FIG. 7 is a block diagram of an audio 3D rendering unit in a media signal processing apparatus according to a second embodiment of the present invention, and FIG. 8 is a block diagram of an audio 3D rendering unit in a media signal processing apparatus according to a third embodiment of the present invention.

Referring to FIG. 7, an audio 3D rendering unit 100B according to a second embodiment of the present invention includes an ambient sound extracting part 110B, an HRTF processing part 120B, a gain applying part 130B, and a generating part 140B. In this case, the ambient sound extracting part 110B extracts a first ambient sound $N_L'$ and a second ambient sound $N_R'$ from an input stereo signal $X_L$ and $X_R$ by the same scheme (e.g., Formula 5) of the former center sound extracting part 110' of the first embodiment.

The HRTF processing part 120B applies an HRTF coefficient to the first and second ambient sounds $N_L'$ and $N_R'$, thereby changing the corresponding sounds into a signal having a specific surround phase.

The gain applying part 130B applies a gain to each of the first and second ambient sounds changed into the signal of the specific surround phase, thereby generating a gain applied first ambient sound and a gain applied second ambient sound. In this case, the gain can include a parameter for adjusting a surround depth.

The generating part 140 adds the gain applied first and second ambient sounds and the input stereo signal (or the center sound) together, thereby generating a virtual surround signal $X_L'$ and $X_R'$.

Referring to FIG. 8, an audio 3D rendering unit 100C according to a third embodiment of the present invention performs HRTF processing on a center sound. In particular, the third embodiment performs the HRTF processing on the center sound, whereas the second embodiment performs the HRTF processing on the ambient sound only.

A center sound extracting part 110C can have the same functionality of the former center sound extracting part 110A of the first embodiment.

Like the former HRTF processing part 120B of the second embodiment, the HRTF processing part 120 of the third embodiment performs the HRTF processing on the ambient sound. Moreover, the HRTF processing part 120C performs the HRTF processing on a center sound S', thereby modifying the corresponding sound into a signal having specific directionality. In this case, direction information on the directionality can include the information received from another module.

Like the second embodiment, the gain applying part 130C adjusts a surround depth by applying a gain to the HRTF processed ambient sound.

And, the generating part 140C generates a virtual surround signal by adding the center sound, the HRTF-processed and gain-applied ambient sound together.

So far, the first to third embodiments 100A to 100C of the audio 3D rendering unit have been examined. In the following description, a media signal processing apparatus, to which one of the first to third embodiments 100A to 100C, is applied, shall be described with reference to FIG. 9 as follows. As mentioned in the foregoing description, an input stereo signal of the audio 3D rendering unit 100A/100B/100C includes a signal recorded by the former method described with reference to FIG. 3 and can be then directly inputted. Yet, in case that a corresponding input stereo signal is received from another entity, a media signal processing apparatus can have the configuration shown in FIG. 9.

Figure 9:
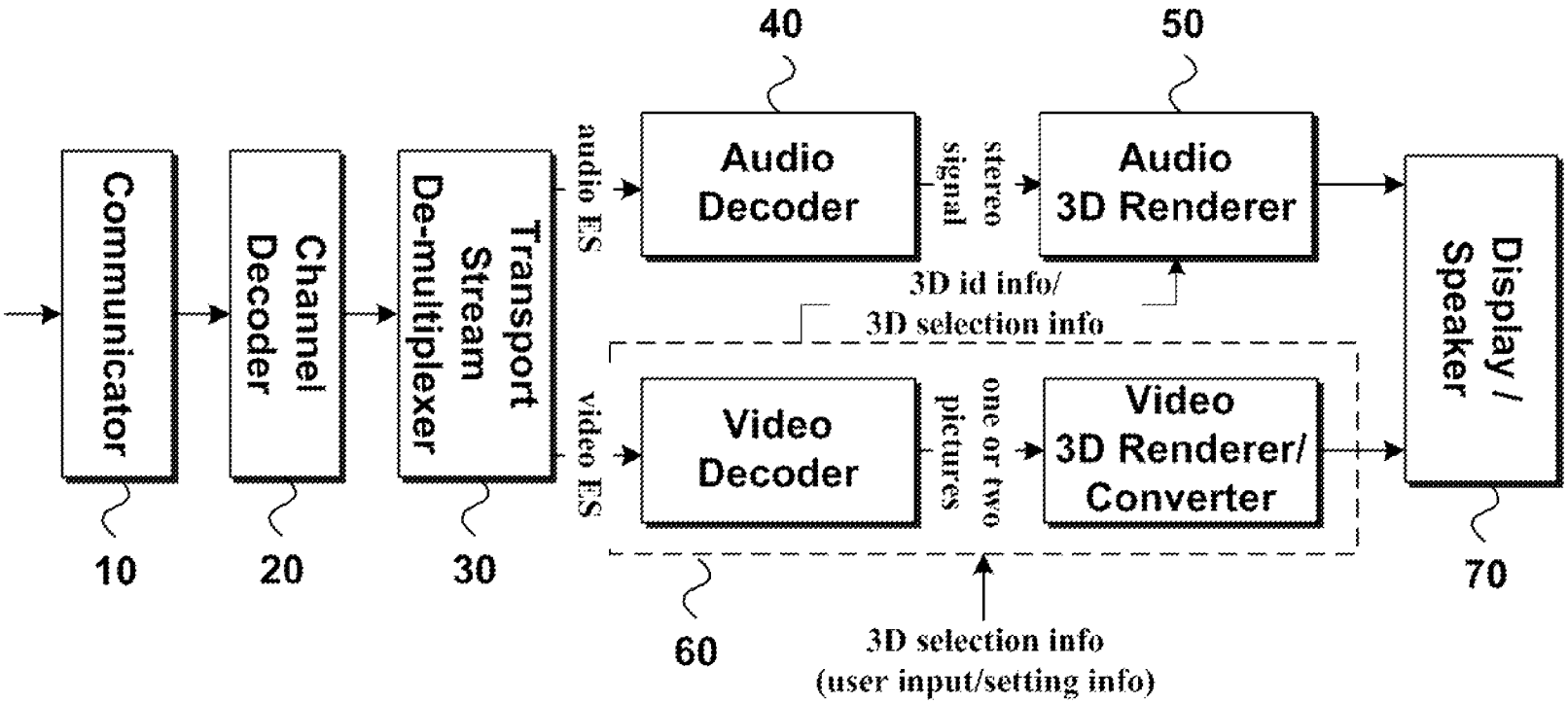
FIG. 9 is a block diagram of a media signal processing apparatus according to an embodiment of the present invention.

FIG. 9 is a block diagram of a media signal processing apparatus according to an embodiment of the present invention.

Referring to FIG. 9, a media signal processing apparatus according to an embodiment of the present invention includes an audio decoder 40, an audio 3D renderer 50, a video processing device 60, and an output device (e.g., display, speaker, etc.) 70. The media signal processing apparatus can further include a communicator 10, a channel decoder 20 and a transport stream demultiplexer 30. Meanwhile, the audio 3D renderer 50, which shall be described with reference to FIG. 10 and FIG. 11, has the configuration that includes the former audio 3D rendering unit 100A/100B/100C. Meanwhile, the video processing device 60 can include a video decoder and a video 3D renderer (or a video 3D converter), of which embodiment shall be described with reference to FIG. 12 later.

The communicator 10 includes a wire/wireless communication device and receives a media signal from an external device or module. For instance, in case of a wireless receiving system, the communicator 10 may include a tuner, by which the present invention is non-limited. In this case, the tuner tunes to a frequency of a predetermined radio wave, selects the corresponding radio wave, and then extracts the selected radio wave only.

The channel decoder 20 performs demodulation on the media signal received via the communicator 10 and then reconstructs the media signal by performing error detection, error correction and the like on the demodulated signal.

The transport stream demultiplexer 30 decodes the media signal of a transport stream type into an audio elementary stream (audio ES) and a video elementary stream (video ES). In this case, the media signal can configure at least one program.

The audio decoder decodes an audio signal of an audio elementary stream (audio ES) type, thereby generating a stereo signal including a first channel signal (e.g., a left signal) and a second channel signal (e.g., a right signal).

The audio 3D renderer 50 is a device that gives or emphasizes a virtual surround effect to a stereo signal according to 3D identity or selection information delivered by the video signal processing device 60. In this case, the 3D identification information is the information for identifying whether a video has 3D characteristics. In particular, the 3D identification information indicates whether a received video signal can be outputted in 3D or whether an outputted video is converted in 3D.

Meanwhile, the 3D selection information is the information indicating whether a user input or setting information has selected an output of 3D video. Even if a received video signal has a characteristic of being outputtable in 3D, 3D playback is not wanted by a user or may not be available due to device characteristics. For this, based on the 3D selection information instead off the 3D identification information, it is able to determine whether to give a 3D effect to an audio signal.

Besides, the audio 3D renderer 50 includes the former audio 3D rendering device 100 described with reference to FIG. 1 and the like. The rest of components except the device 100 shall be described with reference to FIG. 10 and FIG. 11 later.

The video signal processing device 60 decodes a video signal of a video elementary stream (video ES) type, thereby generating at least one picture (for at least one view). The video signal processing device 60 receives the 3D selection information derived from a user input or setting information, reproduces a 2D or 3D video picture based on the received 3D selection information, and delivers the 3D identity or selection information to the audio 3D renderer 50. Meanwhile, there can exist total 3 types of 3D identification information, which shall be described with reference to FIG. 12.

The output device (e.g., display, speaker, etc.) 70 includes a speaker for outputting the stereo signal and a display for playing at least one picture.

Figure 10:
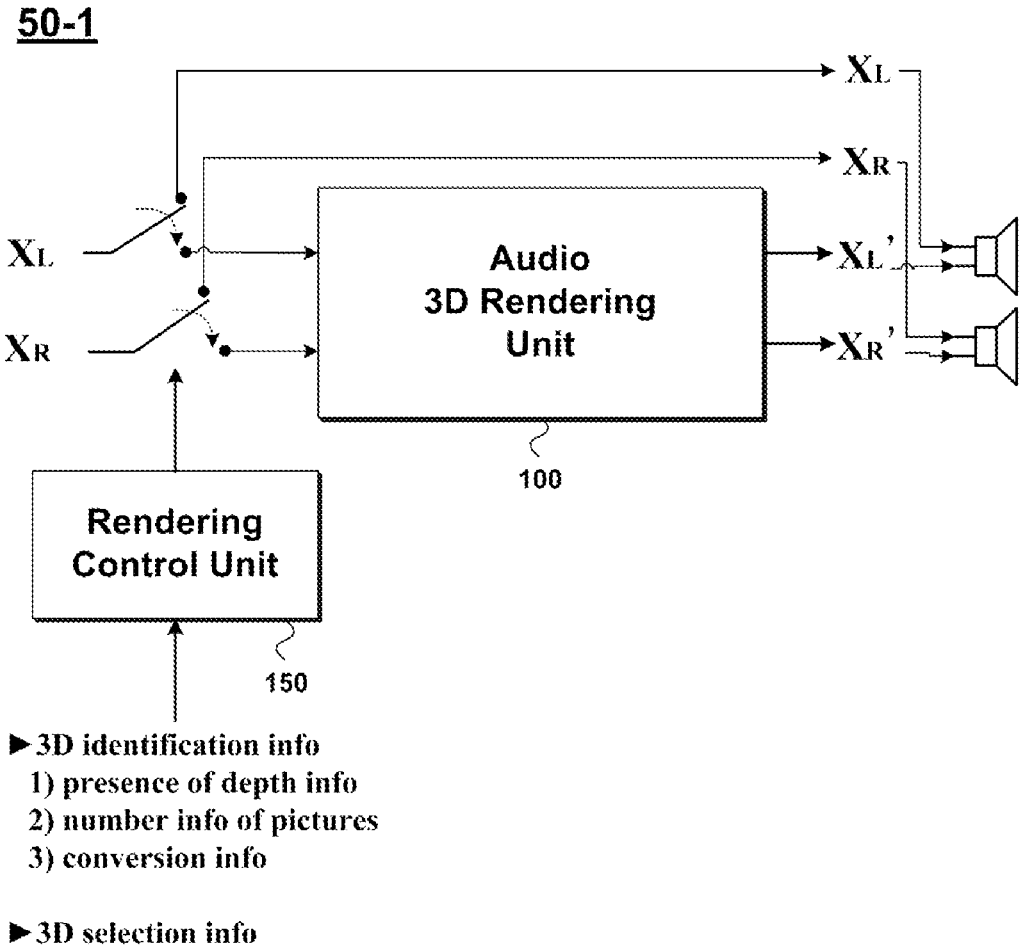
FIG. 10 is a block diagram for one example of an audio 3D renderer 50 in the media signal processing apparatus shown in FIG. 9.
Figure 11:
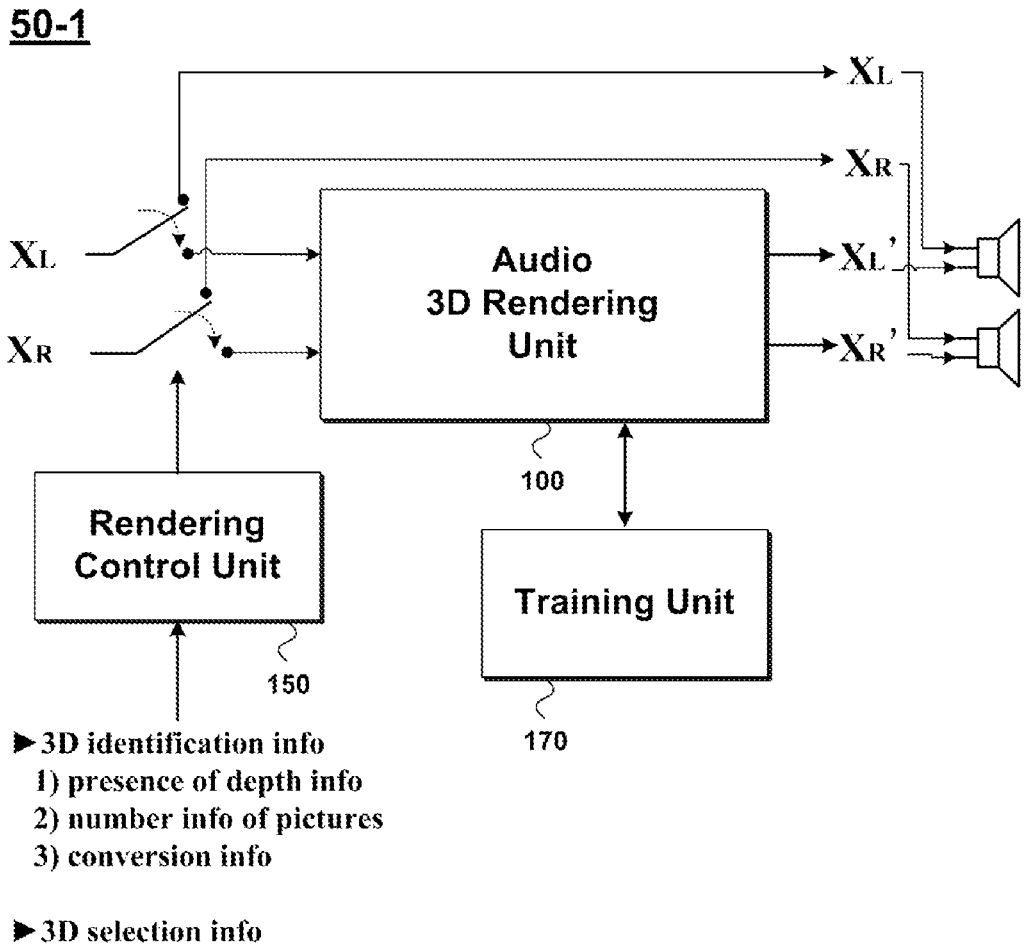
FIG. 11 is a block diagram for another example of an audio 3D renderer 50 in the media signal processing apparatus shown in FIG. 9.

FIG. 10 is a block diagram for one example of an audio 3D renderer 50 in the media signal processing apparatus shown in FIG. 9, and FIG. 11 is a block diagram for another example of an audio 3D renderer 50 in the media signal processing apparatus shown in FIG. 9.

Referring to FIG. 10, an audio 3D renderer 50-1 includes a 3D audio rendering unit 100 and a rendering control unit 150. In this case, the audio 3D rendering unit 100 performs 3D rendering on a stereo input signal $X_L$ and $X_R$, thereby generating a virtual surround signal $X_L'$ and $X_R'$. The details shall be omitted from the following description since the first to third embodiments 100A to 100C have been described with reference to FIG. 1, FIG. 7 and FIG. 8.

Meanwhile, in case that a 3D video picture is identified or outputted, the rendering control unit 150 controls the 3D rendering to be performed on an audio signal. For instance, regarding a content of which video is produced in 3D, by giving a virtual 3D effect to an audio automatically, a user is enabled to sense a 3D effect. Besides, in case of converting a content produced for a 2D image to a 3D video, a presence can be sensed by a user in a manner that a virtual surround signal is automatically generated.

The rendering control unit 150 is able to determine whether a 3D video picture is identified or outputted based on 3D identification information or 3D selection information. In this case, the 3D identification information is the information received from the video signal processing device 60 shown in FIG. 9. In particular, the 3D identification information can correspond to at least one of 1) presence of depth information, 2) information on the number of pictures, and 3) conversion information. Details of the 3D identification information shall be described with reference to FIG. 12 later. Meanwhile, as mentioned in the foregoing description, the 3D selection information is the information indicating whether an output of a 3D video was selected according to the user selection or setting information.

So to speak, the rendering control unit 150 uses the 3D identification information to control a virtual 3D effect on an audio signal based on a characteristic of the outputted video. Otherwise, based on the 3D selection information, the rendering control unit 150 is able to switch a virtual 3D effect based on whether a 3D output of a video signal is attempted. For a media or content, to which the rendering control unit 150 has determined not to give a virtual 3D effect, the stereo signal $X_L$ and $X_R$ bypasses the audio 3D rendering unit 100 and is directly outputted via the speaker.

Referring to FIG. 11, an audio 3D renderer 50-2 of another embodiment includes the components of the former renderer 50-1 shown in FIG. 10 and further includes a training unit 170.

The training unit 170 trains a parameter corresponding to each function in order to optimize a characteristic of such a function included in the audio 3D rendering device 100A/100B/100C as HRTF processing, crosstalk elimination, delay/reverberation filter and the like. For instance, a listener is enabled to listen to each audio signal corresponding to a specific parameter. The listener is then able to select a target having a best surround effect via a user interface. This procedure can be repeated several times. Thus, an optimized parameter can be determined.

Meanwhile, the training unit 170 is able to refer to a training database (not shown in the drawing) in the process of the training. In this case, the training database can include: 1) human related data such as data age, shape of ear, human race, sex, etc.; 2) listener located space (e.g., living room, room, concert hall, etc.); and 3) information indicating whether a player includes a stand TV, a wall-hanging TV, whether a speaker is positioned in front-oriented direction or ground-oriented direction, or the like.

Figure 12:
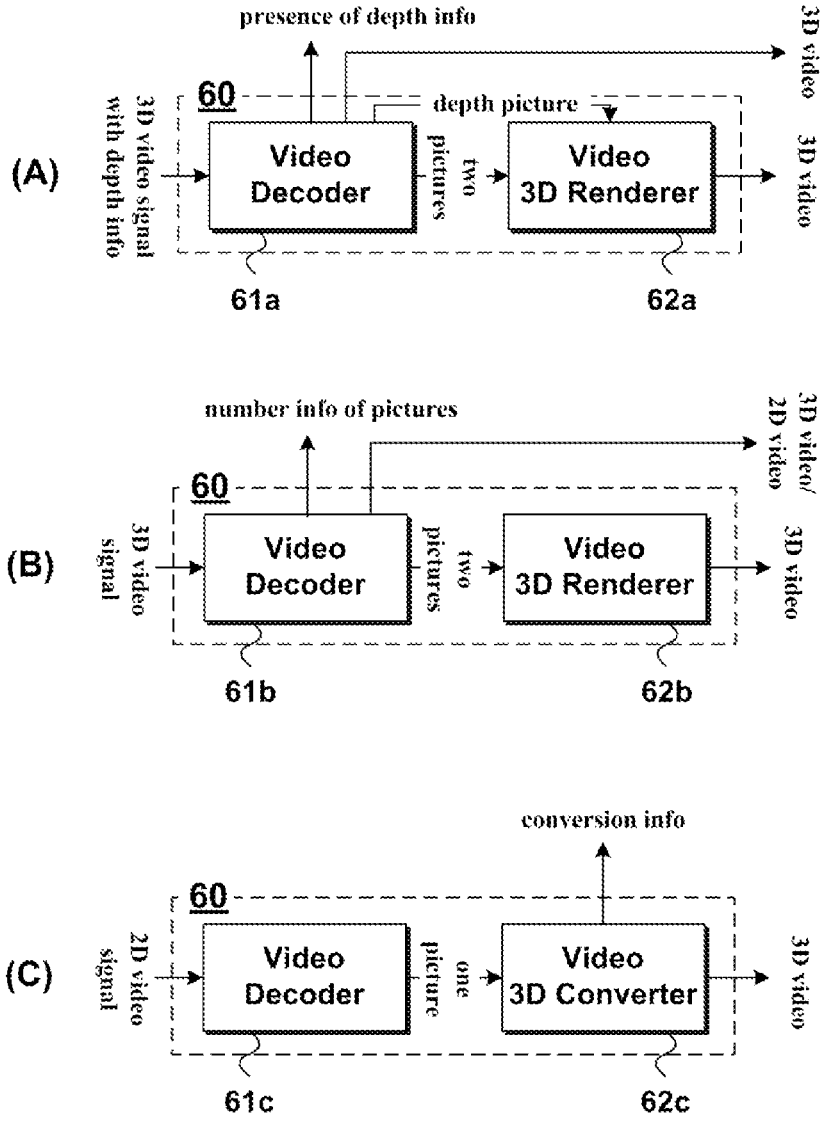
FIG. 12 is a block diagram for examples of a video signal processing device in the media signal processing apparatus shown in FIG. 9.

FIG. 12 is a block diagram for examples of a video signal processing device 60 in the media signal processing apparatus shown in FIG. 9. FIG. 12 (A) shows a case that a 3D video signal including depth information is received. FIG. 12 (B) shows a case that a 3D video signal not including depth information is received. FIG. 12 (C) shows a case that a 2D video signal is received and converted to a 3D video.

Referring to FIG. 12 (A), a video decoder 61*a* reconstructs two pictures from a received video signal. In this case, the two pictures correspond to a 3D video and can correspond to a left eye and a right eye, respectively. If a video signal includes data for multi-view or two-view, it is able to reconstruct the two pictures from the data for the two views according to a multi-view coding (MVC) scheme. In this case, the two pictures are inputted to a video 3D renderer 62*a* or can be directly outputted via a display.

Meanwhile, the video decoder 61*a* extracts depth information from a video signal, reconstructs a depth picture from the extracted depth information, and then delivers the reconstructed picture to the video 3D renderer 62*a*. In this case, the depth means a variation difference generated from a vide difference in a video sequence photographed by a plurality of cameras and the depth picture can mean a set of informations generated from digitizing a distance between a camera's location and an object into a relative value with reference to the camera's location. Thus, in case that the depth picture is reconstructed, the presence or existence of the depth information can be delivered to the aforesaid rendering control unit 150 of the audio 3D renderer 50.

A video 3D renderer 62*a* performs 3D rendering on the received two pictures using the depth picture (and the camera parameter), thereby generating a picture at a virtual camera location. For instance, by performing 3D warping on the two reconstructed pictures using the depth picture, it is able to generate a virtual image at the virtual camera location. Thus, by performing the 3D rendering, it is able to adjust an extent of an image which looks as if popped out of a plane.

Referring to FIG. 12 (B), a video decoder 61*b* decodes/parses/extracts a 3D video signal including data of two pictures. In case of attempting to reproduce the two pictures, a whole video signal is decoded to reconstruct the two pictures. Even if data of the two pictures exist, in case of attempting to reconstruct one of the pictures (i.e., a 2D video) only, the data required for reconstructing the corresponding picture is extracted/parsed/decoded and the corresponding picture is outputted as the 2D video.

If a signal includes a 3D video signal, the video decoder 61*b* is able to determine whether data for a prescribed number of pictures (views) exists. The video decoder 61*b* delivers the information on the number of pictures to the rendering control unit 150 as well.

Thus, in case that both of the two pictures are reconstructed as 3D video, the 3D video is outputted via the display as it is or can be rendered by a video 3D renderer 62*b*.

Referring to FIG. 12 (C), a video decoder 61C receives a 2D video signal, decodes the received 2D video signal, and then reconstructs one picture (i.e., a picture for one view). A video 3D converter 62C generates a 3D video using a 2D picture through 2D-to-3D conversion. In this case, the video 3D converter 62C delivers conversion information indicating the conversion to the 3D video to the rendering control unit 150.

Referring now to FIG. 10, in the above three cases, the video processing device 60 considers the received information (e.g., the existence of the depth information, the information on the number of pictures, the conversion information, etc.) as the 3D identification information. The rendering control unit 150 then determines whether to give a virtual surround effect to the audio signal based on the 3D identification information.

The media signal processing apparatus according to the present invention is available for various products to use. Theses products can be mainly grouped into a stand alone group and a portable group. A TV, a monitor, a settop box and the like can be included in the stand alone group. And, a PMP, a mobile phone, a navigation system and the like can be included in the portable group.

Figure 13:
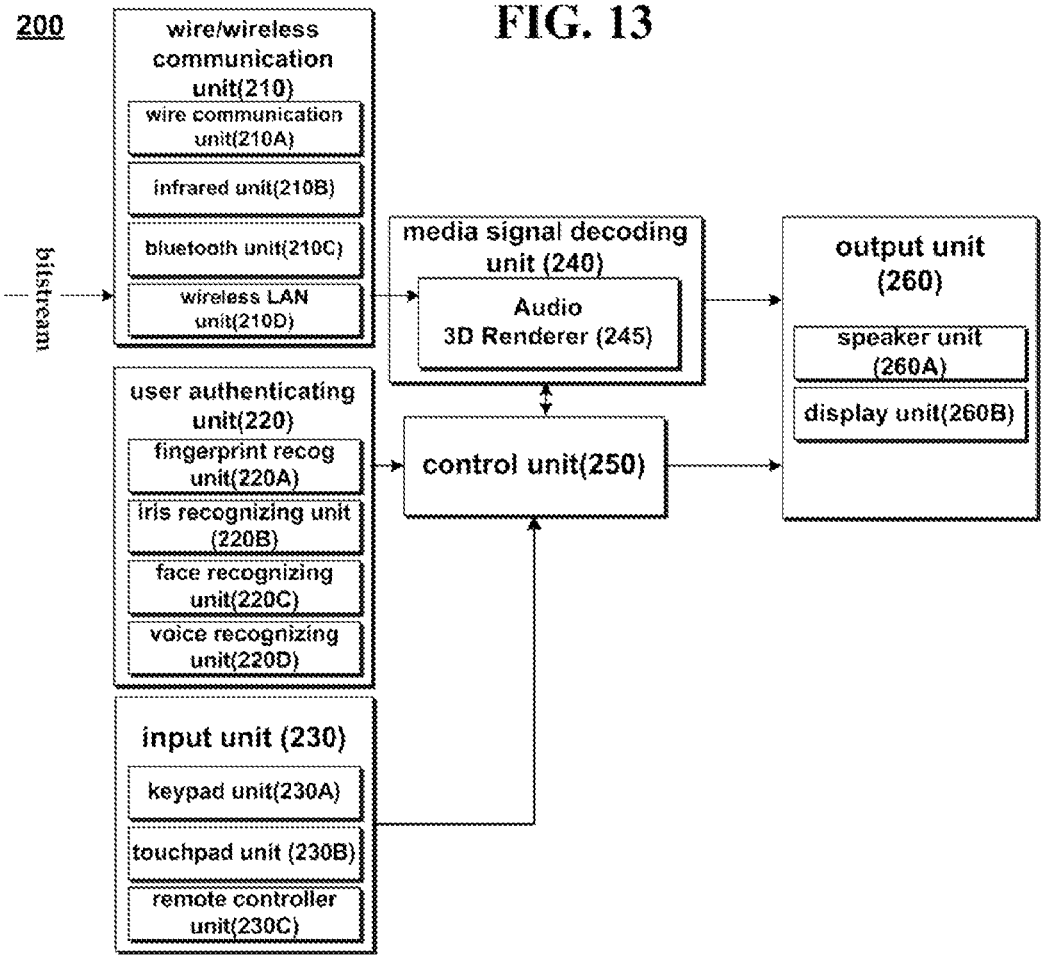
FIG. 13 is a schematic block diagram of a product in which a media signal processing apparatus according to an embodiment of the present invention is implemented.

FIG. 13 shows relations between products, in which a media signal processing apparatus according to an embodiment of the present invention is implemented.

Referring to FIG. 13, a wire/wireless communication unit 210 receives a bitstream via wire/wireless communication system. In particular, the wire/wireless communication unit 210 can include at least one of a wire communication unit 210A, an infrared unit 210B, a Bluetooth unit 210C and a wireless LAN unit 210D.

A user authenticating unit 220 receives an input of user information and then performs user authentication. The user authenticating unit 220 can include at least one of a fingerprint recognizing unit 220A, an iris recognizing unit 220B, a face recognizing unit 220C and a voice recognizing unit 220D. The fingerprint recognizing unit 220A, the iris recognizing unit 220B, the face recognizing unit 220C and the speech recognizing unit 220D receive fingerprint information, iris information, face contour information and voice information and then convert them into user informations, respectively. Whether each of the user informations matches pre-registered user data is determined to perform the user authentication.

An input unit 230 is an input device enabling a user to input various kinds of commands and can include at least one of a keypad unit 230A, a touchpad unit 230B and a remote controller unit 230C, by which the present invention is non-limited.

A signal coding unit 240 performs encoding or decoding on a media signal (e.g., an audio signal and/or a video signal), which is received via the wire/wireless communication unit 210, and then outputs an audio signal in time domain. The signal coding unit 240 includes an audio 3D renderer 245. As mentioned in the foregoing description, the audio 3D renderer 245 corresponds to the above-described audio 3D renderer 50/50-1/50-2 according to the former embodiments described with reference to one of FIGS. 9 to 11. Thus, the audio 3D renderer 245 and the signal coding unit including the same can be implemented by at least one or more processors.

A control unit 250 receives input signals from input devices and controls all processes of the signal decoding unit 240 and an output unit 260. In particular, the output unit 260 is an element configured to output an output signal generated by the signal decoding unit 240 and the like and can include a speaker unit 260A and a display unit 260B. If the output signal is an audio signal, it is outputted to a speaker. If the output signal is a video signal, it is outputted via a display.

Figure 14:
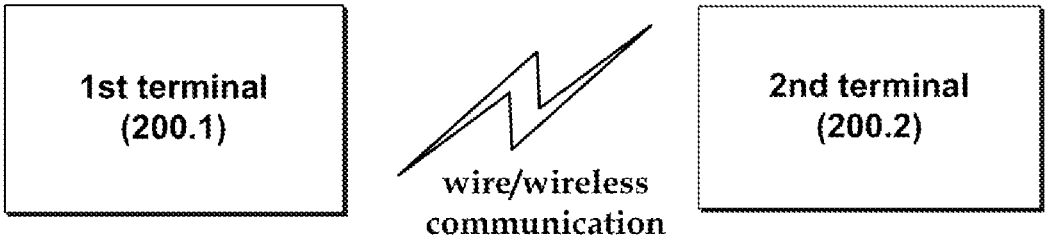
FIG. 14 is a block diagram for relations between products in each of which a media signal processing apparatus according to an embodiment of the present invention is implemented.
Figure 14:
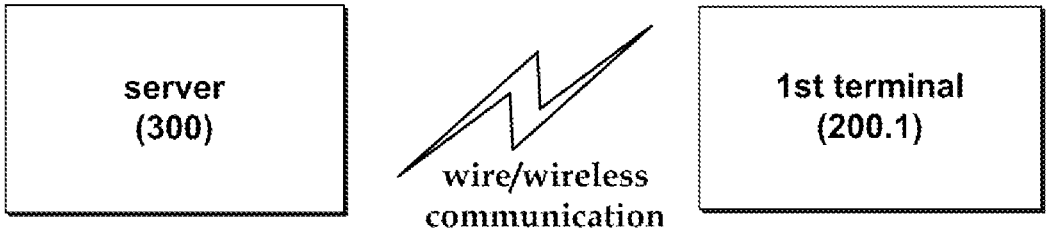

FIG. 14 is a diagram for relations of products provided with a media signal processing apparatus (or an audio 3D renderer) according to an embodiment of the present invention. FIG. 14 shows the relation between a terminal and server corresponding to the products shown in FIG. 13.

Referring to FIG. 14 (A), it can be observed that a first terminal 200.1 and a second terminal 200.2 can exchange data or bitstreams bi-directionally with each other via the wire/wireless communication units. Referring to FIG. 14 (B), it can be observed that a server 300 and a first terminal 200.1 can perform wire/wireless communication with each other.

A media signal processing method according to the present invention can be implemented into a computer-executable program and can be stored in a computer-readable recording medium. And, multimedia data having a data structure of the present invention can be stored in the computer-readable recording medium. The computer-readable media include all kinds of recording devices in which data readable by a computer system are stored. The computer-readable media include ROM, RAM, CD-ROM, magnetic tapes, floppy discs, optical data storage devices, and the like for example and also include carrier-wave type implementations (e.g., transmission via Internet). And, a bitstream generated by the above mentioned encoding method can be stored in the computer-readable recording medium or can be transmitted via wire/wireless communication network.

Accordingly, the present invention is applicable to processing and outputting an audio or media signal.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A method for processing a media signal, comprising:

receiving, by an audio processing apparatus, an audio signal including a first channel signal and a second channel signal;

estimating a center sound by applying a band-pass filter to the first channel signal and the second channel signal;

obtaining a first ambient sound by subtracting the center sound from the first channel signal;

obtaining a second ambient sound by subtracting the center sound from the second channel signal;

canceling cross-talk on at least one of the first ambient sound and the second ambient sound;

applying at least one of a delay filtering and a reverberation filtering to at least one of the first ambient sound and the second ambient sound to generate a processed ambient sound; and generating a pseudo surround signal using the center sound and the processed ambient sound, wherein the at least one of the delay filtering and the reverberation filtering is applied to the first ambient sound or the second ambient sound from which the cross-talk is canceled.

2. The method of claim 1, wherein a frequency range of the band-pass filter is based on voice band.

3. The method of claim 1, wherein a frequency range of the band-pass filter is from about 250 Hz to about 5 kHz.

4. The method of claim 1, wherein the center sound is estimated by the band-pass filter to a sum signal which is generated by adding the first channel signal to the second channel signal.

5. The method of claim 1, further comprising:

receiving a video signal including at least one of a first picture data and a second picture data, wherein, when 3D video picture is output based on the video signal, the pseudo surround signal is generated.

6. The method of claim 5, further comprising:

deciding whether the 3D video picture is output, according to 3D identification information, wherein the 3D identification information corresponds to at least one of presence of depth information, number information of pictures, and conversion information.

7. The method of claim 6, wherein the presence of depth information is generated according to whether the video signal includes depth information, wherein the number information of pictures is generated according to whether two pictures are decoded from the video signal, and wherein the conversion information is generated according to whether one picture is converted into two pictures.

8. The method of claim 5, wherein the 3D video picture is output according to 3D selection information estimated from a user input or setting information.

9. An apparatus for processing a media signal, comprising:

a communication device configured to receive a bitstream signal and output an audio signal:

a band-pass filter configured to receive the audio signal, and filter the audio signal to generate a first channel signal and a second channel signal, wherein a first ambient sound is produced by subtracting, via a center sound extractor, a center sound of the audio signal from the first channel signal, wherein a second ambient sound is produced by subtracting, via the center sound extractor, the center sound of the audio signal from the second channel signal, and wherein cross-talk on at least one of the first ambient sound and the second ambient sound is canceled by a crosstalk cancellation (C-T-C) part;

at least one of a delay filter and a reverberation filter configured to filter at least one of the first ambient sound of the first channel signal and the second ambient sound of the second channel signal to generate via a processor, a processed ambient sound of the first and second channel signals, wherein a pseudo surround audio signal is generated via a generator, from the center sound of the audio signal and the processed ambient sound of the first and second channel signals; and a speaker device configured to receive the pseudo surround audio signal from the generator, and output pseudo surround audio sound based upon the received pseudo surround audio signal, wherein the at least one of the delay filter and the reverberation filter is configured to filter the first ambient sound or the second ambient sound from which the cross-talk is canceled.

10. The apparatus of claim 9, wherein a frequency range of the band-pass filter is based on voice band.

11. The apparatus of claim 9, wherein a frequency range of the band-pass filter is from about 250 Hz to about 5 kHz.

12. The apparatus of claim 9, wherein the center sound is estimated by the band-pass filter to a sum signal which is generated by adding the first channel signal to the second channel signal.

13. The apparatus of claim 9, further comprising:

a video decoder configured to receive a video signal including at least one of a first picture data and a second picture data, wherein, when 3D video picture is output based on the video signal, the pseudo surround signal is generated.

14. The apparatus of claim 13, further comprising:

a rendering control unit configured to decide whether the 3D video picture is output, according to 3D identification information, wherein the 3D identification information corresponds to at least one of a presence of depth information, number information of pictures, and conversion information.

15. The apparatus of claim 14, wherein the presence of depth information is generated according to whether the video signal includes depth information, wherein the number information of pictures is generated according to whether two pictures are decoded from the video signal, and wherein the conversion information is generated according to whether one picture is converted into two pictures.

16. The apparatus of claim 13, wherein the 3D video picture is output according to 3D selection information estimated from a user input or setting information.

* * * * *